United States Patent [19]

Sasaki et al.

[11] 4,244,310

[45] Jan. 13, 1981

[54] ZIGZAG SEWING MACHINE WITH A TRIMMING DEVICE

[75] Inventors: Toshio Sasaki, Inazawa; Osamu Kamiya, Nagoya, both of Japan

[73] Assignee: Brother Kogyo Kabushiki Kaisha, Nagoya, Japan

[21] Appl. No.: 80,806

[22] Filed: Oct. 1, 1979

[30] Foreign Application Priority Data

Oct. 14, 1978 [JP] Japan ..... 53-126359

[51] Int. Cl.[3] ..... D05B 37/00; D05B 3/02

[52] U.S. Cl. ..... 112/126; 112/77; 112/158 R; 112/158 B

[58] Field of Search ..... 112/126, 122, 129, 123, 112/158 R, 77, 158 B, 127, 128

[56] References Cited

U.S. PATENT DOCUMENTS

| | | | |
|---|---|---|---|
| 1,469,422 | 10/1923 | Luscher | 112/122 |
| 2,427,609 | 9/1947 | Knaus | 112/126 |
| 2,432,545 | 12/1947 | Sigoda | 112/122 X |
| 2,472,862 | 6/1949 | Sigoda | 112/127 |
| 2,493,735 | 1/1950 | Alifano et al. | 112/128 |
| 2,917,013 | 12/1959 | Bungent | 112/127 |
| 3,029,759 | 4/1962 | Sigoda | 112/127 |
| 3,125,048 | 3/1964 | Tringali | 112/126 |

*Primary Examiner*—H. Hampton Hunter
*Attorney, Agent, or Firm*—George B. Oujevolk

[57] ABSTRACT

Disclosed is a zigzag sewing machine in which a trimming device for trimming the marginal edge of a work fabric is removably disposed at a predetermined position on a machine bed so that the trimming device is driven in relation to the operation of the sewing machine. The zigzag sewing machine comprises a switching device for changing the field position of the needle oscillation and an operated member for actuating the switching device in relation to the disposition of the trimming device at the predetermined position. In this zigzag sewing machine, while overedge stitching is performed by using the trimming device, the field position of the needle oscillation is set so that zigzag stitches having a desired stitch width are always placed along and over the marginal edge of the work fabric trimmed by the trimming device.

10 Claims, 16 Drawing Figures

ZIGZAG SEWING MACHINE WITH A TRIMMING DEVICE

BACKGROUND OF THE INVENTION

1. Field of the Invention

The present invention relates to a zigzag sewing machine in which a trimming device is removably disposed at a predetermined position on a machine bed, the marginal edge of a work fabric is trimmed by this trimming device and an overedge seam is formed along and over the trimmed edge.

2. Description of the Prior Art

A trimming device removably mounted on a bed of a zigzag sewing machine having a laterally joggable needle for forming zigzag stitches of variable stitch width to trim the marginal edge of a work fabric prior to overedge stitching has already been known. In a zigzag sewing machine provided with such trimming device on performing overedge stitching, the field position of the needle oscillation should be set so that formed zigzag stitches are placed along the marginal edge of the trimmed work fabric. When this setting operation is neglected, the zigzag stitches of any stitch width are not often placed along and over the trimmed marginal edge of the work fabric, and so, an overedge seam for overcasting the trimmed marginal edge is not formed.

A known trimming device for a zigzag sewing machine is constructed so that the attaching position thereof to a sewing needle can be adjusted. However, various limitations are imposed on this adjustment of the attachment position because of the structure of the sewing machine and this adjustment is troublesome for an operator. Accordingly, such trimming device is not suitably used for ordinary household zigzag sewing machines.

SUMMARY OF THE INVENTION

It is a primary object of the present invention to eliminate the foregoing defect involved in the conventional technique.

The zigzag sewing machine of the present invention comprises a switching device for changing the field position of the needle oscillation and an operated member for actuating the switching device in relation to disposition of a trimming device at a predetermined position. In this zigzag sewing machine, the field position of the needle oscillation is automatically changed and set in relation to disposition of the trimming device at the predetermined position for performing overedge stitching by using the trimming device, so that zigzag stitches having a desired stitch width are always placed along and over the marginal edge of a work fabric trimmed by the trimming device.

Further, when the trimming device is withdrawn from the predetermined position on the machine bed of performing ordinary zigzag stitching, said operated member is turned over to the non-operative state and the field position of the needle oscillation is automatically changed and set at the original position. It is therefore another object of the present invention to provide a novel device for changing the field position of the needle oscillation.

DETAILED DESCRIPTION OF THE PREFERRED EMBODIMENTS

The structure of a zigzag sewing machine according to one embodiment of the present invention will now be described with reference to the accompanying drawings.

Figure 1:
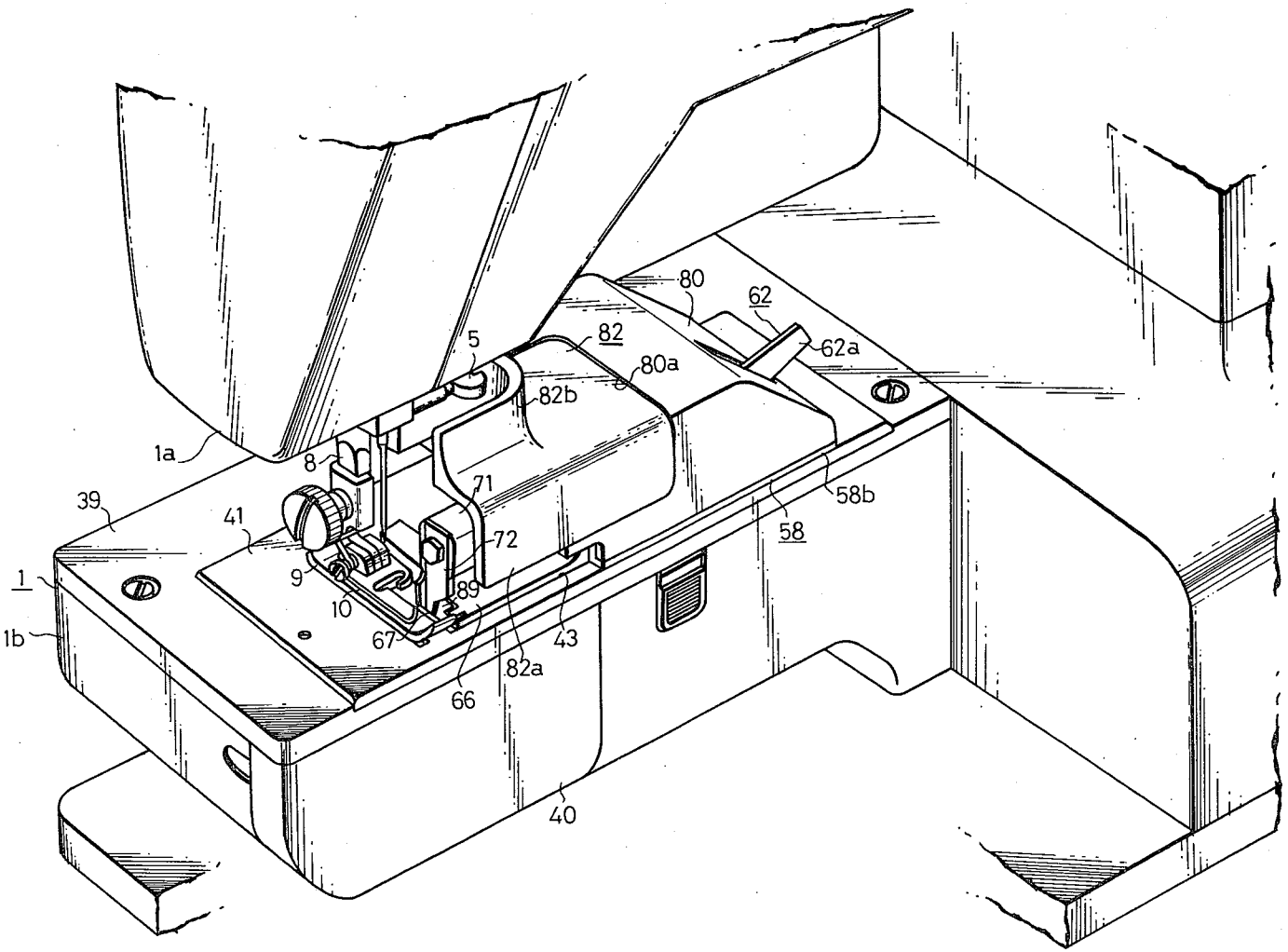
FIG. 1 is a perspective view illustrating one embodiment of a zigazg sewing machine of the present invention which is provided with a trimming attachment.
Figure 2:
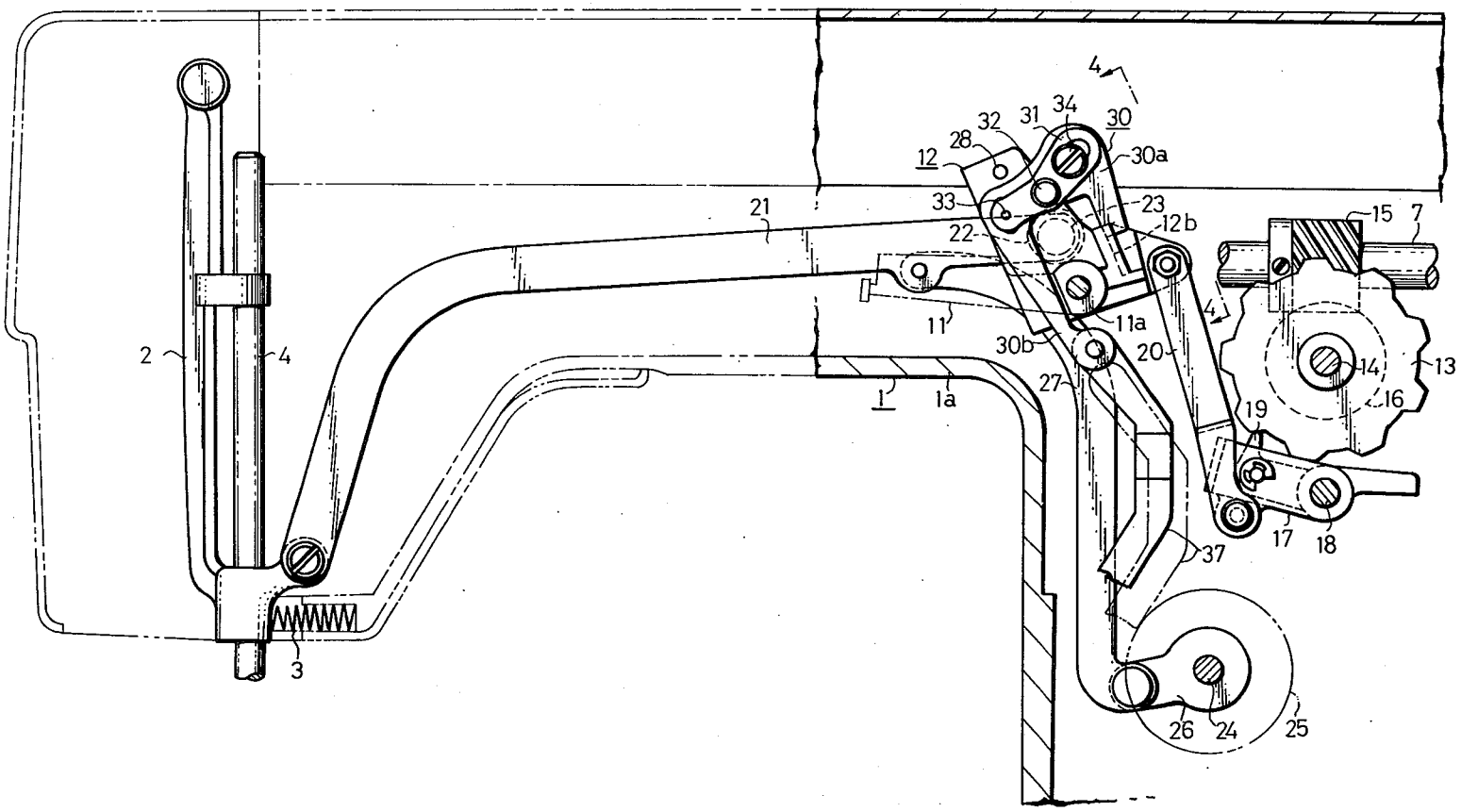
FIG. 2 is a longitudinally sectional partial view showing a needle oscillating mechanism while cutting out an arm portion of the machine frame.

Referring to FIG. 1, a machine frame 1 comprises an arm portion 1*a* and bed portion 1*b*. As shown in FIG. 2, a needle gate 2 is supported laterally joggably in the head of the arm portion 1*a*. A compression spring 3 is interposed between the needle gate 2 and the arm portion 1*a* to urge the needle gate 2 to the left in FIG. 2. A needle bar 4 is supported for endwise reciprocation on the needle gate 2, and as shown in FIG. 1, a sewing needle 6 is attached to the lower end of the bar 4 by a screw 5. The needle bar 4 is reciprocatively moved in the vertical direction sychronously with rotation of a main shaft 7 journaled in the arm 1*a*. A pressure bar 8 is disposed in the head of the arm portion 1*a* and a pressure foot 9 is attached to the lower end of the pressure bar 8. In this embodiment, the pressure foot 9 is urged by a wire spring 10 to turn in the clockwise direction in FIG. 1. A work fabric is effectively pressed also by the front end of the pressure foot 9.

Figure 5:
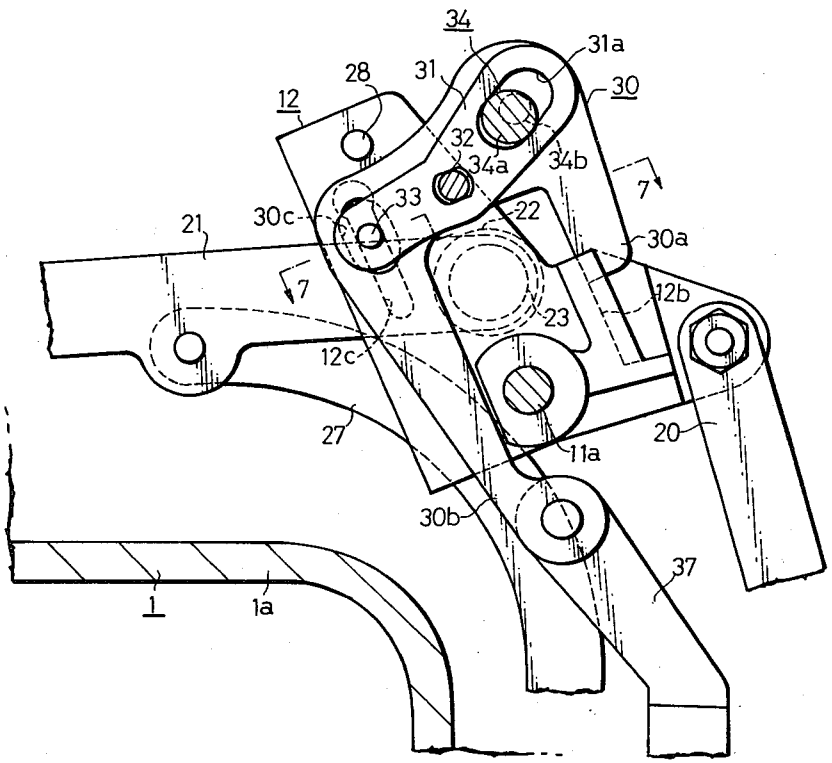
FIG. 5 is a view showing the section taken substantially along the line 5—5 in FIG. 4.
Figure 6:
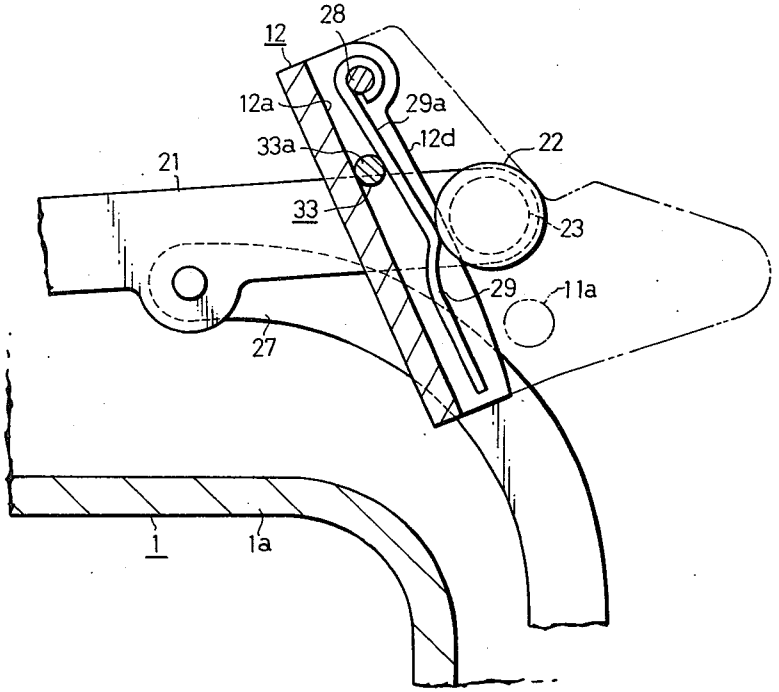
FIG. 6 is a view showing the section taken substantially along the line 6—6 in FIG. 4.

A support plate 11 is fixed in the arm portion 1*a* of the frame 1 and as shown in FIG. 2, a support shaft 11*a* is projected from one end of the support plate 11. A rock member 12 is swingably supported at the lower end thereof on the support shaft 11*a* and is formed to have a substantially lateral-U-shape in plan. As shown in FIGS. 5 and 6, a guide surface 12*a* and a guide groove 12*b* extending in the same direction are formed on the left end between the front and rear walls of the rock member 12 and on the right end of the front wall of the rock member 12 respectively. A guide slot 12*c* extending in parallel to the guide surface 12*a* is formed on the front wall of the rock member 12. An arcuate first abutment surface 12*d* is formed on the right end of the rear wall of the rock member 12. A plurality of pattern cams 13 are supported rotatably in the machine frame 1 by a cam shaft 14 below the main shaft 7. As shown in FIG. 2, the pattern cams 13 are rotated by rotation of the main shaft 7 through gears 15 and 16. A support arm 17 having a substantially lateral-U-shape in plan is supported rotatably in the machine frame 1 by a pivot shaft 18 below the pattern cams 13, and a cam follower 19 is supported on the pivot shaft 18 rotatably and slidably to rotate integrally with the support arm 17. The cam follower 19 is arranged so that when one desired stitch pattern is selected by an appropriate operation knob on reference to representations on a pattern display panel (not shown) disposed on the front surface of the frame 1, the cam follower 19 falls in engagement with one corresponding pattern cam 13, as in the known sewing machine. An actuating link 20 is disposed between the rock member 12 and the support arm 17 to transmit the swinging motion of the cam follower 19 to the rock member 12 and swing the rock member 12 around the support shaft 11*a* according to the shape of the selected pattern cam 13.

Figure 8:
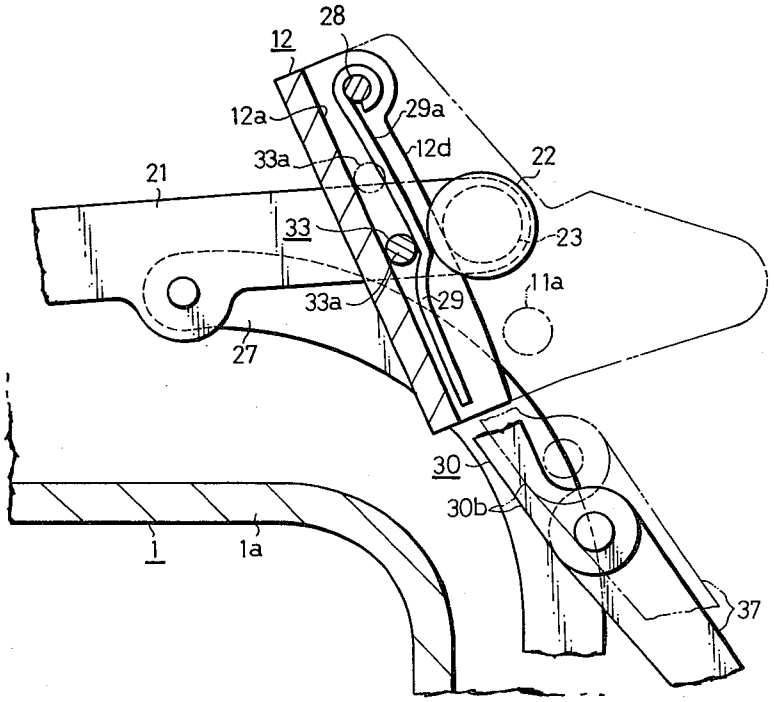
FIG. 8 is a sectional view corresponding to FIG. 6, which illustrates a different operation state.
Figure 9:
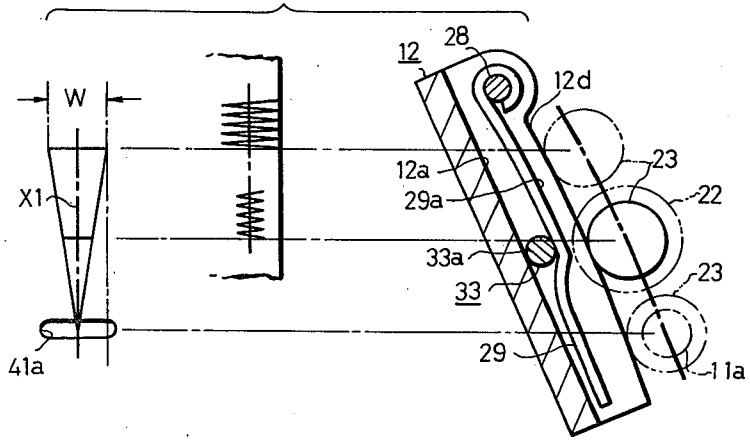
FIG. 9 is a diagram illustrates the state of setting of the field position of the needle oscillation at the step of ordinary zigzag stitching.

A needle bar connecting rod 21 is operatively connected to the lower end of the needle gate 2, and as shown in FIG. 2 and FIGS. 4 to 7, a large-diameter contact element 22 and a small-diameter contact roller 23 are concentrically disposed on the right edge of the connecting rod 21. The connecting rod 21 is ordinarily held, by the urging force of the compression spring 3 imposed on the needle gate 2, in the state where the contact roller 23 is engaged with the first abutment surface 12*d* of the rock member 12, as shown in FIG. 8. In this state, the lateral jogging motion according to the swing of the rock member 12 is applied to the needle 6 located on the lower end of the needle bar 4, and as shown in FIG. 9, the needle 6 swings at a predetermined amplitude with the base line X1 based on the first abutment surface 12*d* being as the center and a desired stitch pattern is formed at the so-called central field position. An operated shaft 24 is rotatably supported on the front wall of the machine frame 1 while piercing therethrough. As shown in FIG. 2, a knob 25 is attached to the front end of the operated shaft 24, and a rotating lever 26 is fixed to the rear end of the operated shaft 24. A regulating link 27 has both the ends thereof connected to the top end of the rotating lever 26 and the right end of the connecting rod 21, respectively. The regulating link 27 is moved in the vertical direction by the rotating operation of the knob 25 so that the engaging position of the contact roller 23 on the connecting rod 21 with the first abutment surface 12*d* of the rock member 12 is adjusted and changed in the range between the position where the contact roller 23 is in agreement with the pivotal axis of the rock member 12, that is, the center of the support shaft 11*a* and the position where the contact roller 23 is remotest from the pivotal axis, as shown in FIG. 9, whereby the oscillation amplitude of the needle 6 can be adjusted.

Figure 10:
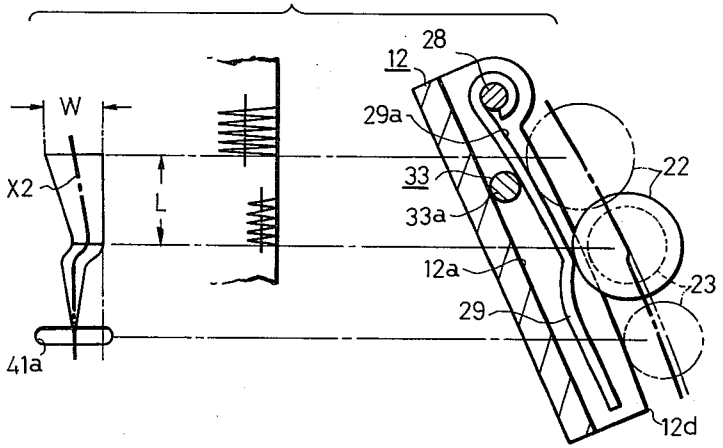
FIG. 10 is a diagram illustrating the state of setting of the field position of the needle oscillation at the step of overedge stitching by using a trimming device.

A support pin 28 is disposed between the front and rear walls of the rock member 12 at a position remote from the pivotal axis of the rock member. A switching member 29 is rotatably supported between the front and rear walls of the rock member 12 adjacently to the abutment surface 12*d*. As shown in FIG. 6, an arcuate second abutment surface 29*a* is formed on the upper half of the right side of the switching member 29 so that the surface 29*a* can be selectively engaged with the large-diameter contact element 22 on the connecting rod 21 instead of the engagement of the first abutment surface 12*d* with the small-diameter contact roller 23 on the connecting rod 21. By the engagement of the second abutment surface 29*a* with the contact element 22, the relative connective position of the connecting rod 21 to the rock member 12 is changed in the lengthwise direction of the connecting rod 21. In this engagement state between the second abutment surface 29*a* and the contact element 22, the needle 6 is oscillated with the base line X2 based on the second abutment surface 29*a* shown in FIG. 10, which is different from the base line X1 shown in FIG. 9, being as the center, within a region L where an oscillation amplitude of the needle 6 is suitable for overedge stitching, for example, within an adjustment region between a medium oscillation amplitude of about 2.5 mm and a maximum amplitude W of about 5.0 mm. In this case, the field position of the needle oscillation for the needle 6 is changed without the position of the pivotal axis of the rock member 12 being changed, and a desired stitch pattern is formed on the so-called right field position of the needle oscillation along the right end position of the maximum oscillation region W at any amplitude in the region L.

Figure 4:
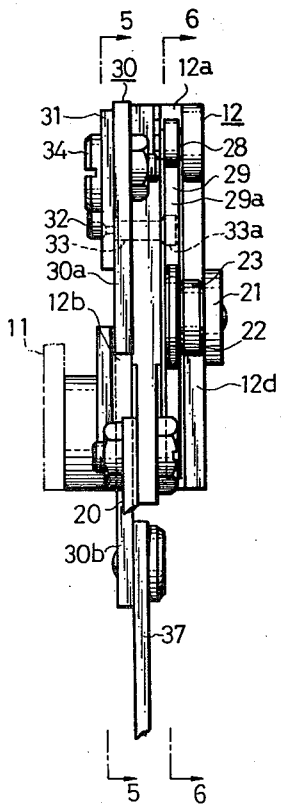
FIG. 4 is an enlarged partial front view seen substantially along the line 4—4 in FIG. 2.
Figure 7:
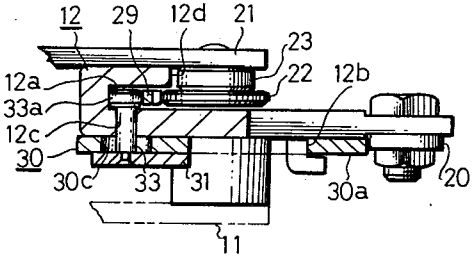
FIG. 7 is a view showing the section taken substantially along the line 7—7 in FIG. 5.

As shown in FIGS. 4, 5 and 7, an actuating arm 30 comprises a guide portion 30*a* hanging down on one side, which is fitted in the guide groove 12*b* of the rock member 12, and the actuating arm 30 is mounted on the front surface of the rock member 12 movably in the vertical direction. A connection portion 30*b* hangs down on the other side of the actuating arm 30 and a through hole 30*c* extended in the vertical direction is formed in the vicinity of the top end of the connection portion 30*b*. An actuating plate 31 is attached at the central portion thereof to the front surface of the actuating arm 30 by a pin 32 so that the actuating plate 31 can be rotated and slightly moved in the lateral direction. A slot 31*a* extended in the lateral direction is formed on the right end of the actuating plate 31. As shown in FIGS. 5 to 8, an actuating pin 33 is projected on the rear surface on the left end of the actuating plate 31 and is extended backward through the hole 30*c* of the actuating arm 30 and the guide slot 12*c* of the rock member 12. An actuating element 33*a* is provided on the rear end of the actuating pin 33 at a position between the guide surface 12*a* of the rock member 12 and the left surface of the switching member 29. The actuating element 33*a* is arranged so that when the actuating arm 30 is moved upwardly together with the actuating plate 31 as shown in FIG. 5, the switching member 29 is located at the operative position shown in FIG. 6, and when the actuating arm 30 is moved downwardly, the switching member 29 is rested at the non-operative position shown in FIG. 8. An adjusting screw 34 is screwed with the actuating arm 30 from the front surface of the actuating plate 31 through the slot 31*a*. As shown in FIG. 5, the adjusting screw 34 includes a screw portion 34*b* and a stepped portion 34*a* formed eccentrically with the screw portion 34*b* to engage with the slot 31*a*. Accordingly, by turning the adjusting screw 34, the attaching position of the actuating plate 31 to the actuating arm 30 is changed, and the engaging position of the actuating pin 33 and the switching member 29 is adjusted in the vertical direction when the actuating arm 30 is located at the elevated position to shift the switching member 29 at the predetermined operative position.

Figure 3:
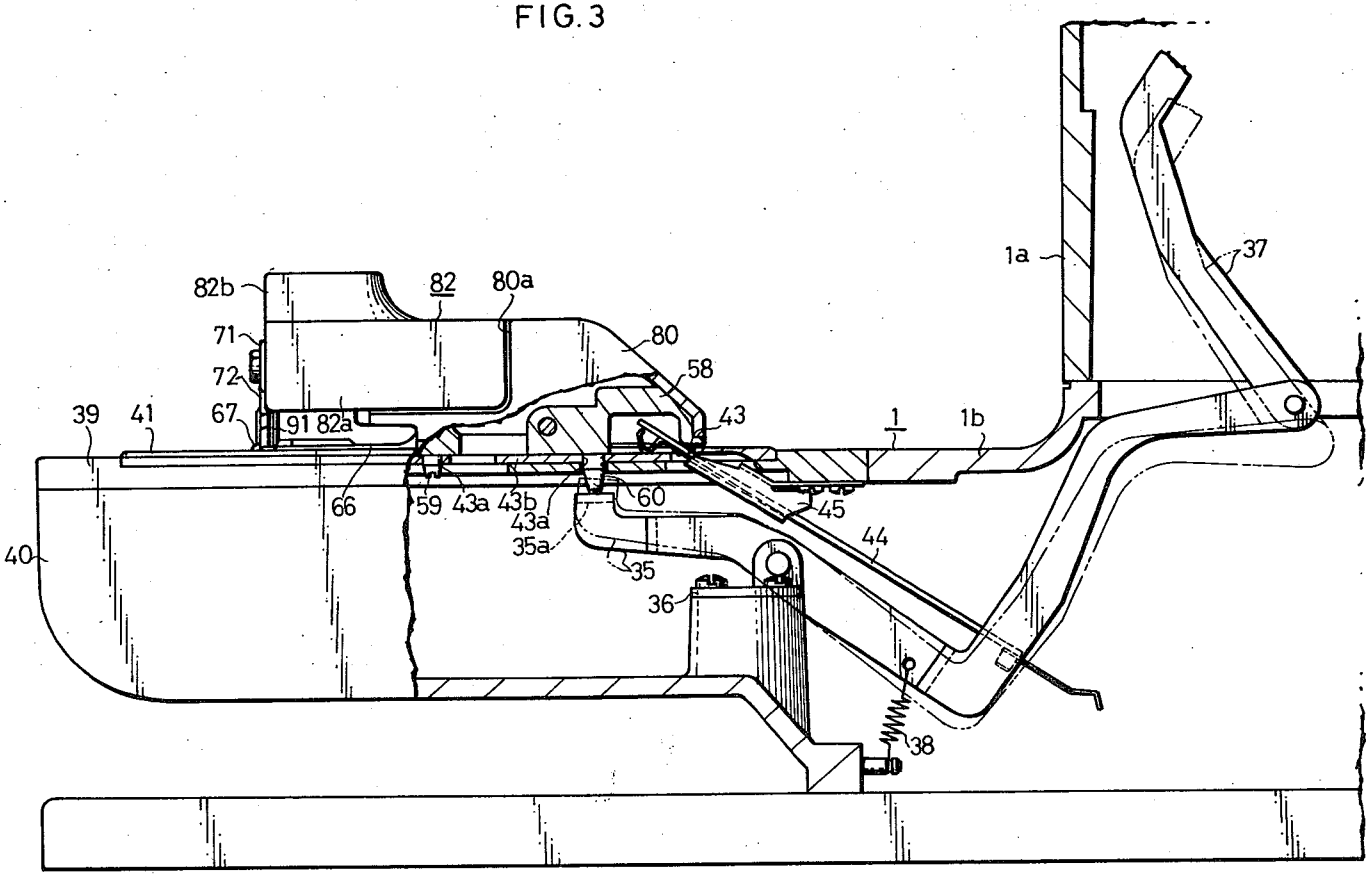
FIG. 3 is a partial front view showing a mechanism in a bed portion while cutting out a part of the machine frame.

As shown in FIG. 3, an operated lever 35 is rotatably mounted in the bed portion 1*b* of the machine frame 1 by an attaching plate 36. An operated portion 35*a* is formed on one end of the lever 35 and is located slightly below the top surface of the bed portion 1*b*. A link 37 has both the ends thereof connected to the other end of the operated lever 35 and the connection portion 30*b* of the actuating arm 30, respectively. The actuating arm 30 is moved in the vertical direction by the turning movement of the operated lever 35 to shift and locate the switching member 29 selectively at the operative position or the non-operative position. A tension spring 38 is disposed between the operated lever 35 and the frame 1 to urge the lever 35 in the clockwise direction in FIG. 3. Accordingly, the operated lever 35 is rested at a normal position indicated by a chain line in FIG. 3 to maintain the switching member 29 stationarily at the non-operative position shown in FIG. 8.

In the foregoing embodiment, when a trimming attachment is disposed and locked on the bed portion 1*b* of the frame 1, in relation to this disposition operation, the operated lever 35 is turned from the position indicated by a chain line to the position indicated by a solid line in FIG. 3, whereby the switching member 29 is shifted from the non-operative position shown in FIG. 8 to the operative position shown in FIG. 6, and the sewing field position of the needle oscillation is automatically shifted from the central position to the right position and set in this state.

The structure of the foregoing embodiment will now be described more in detail.

Figure 11:
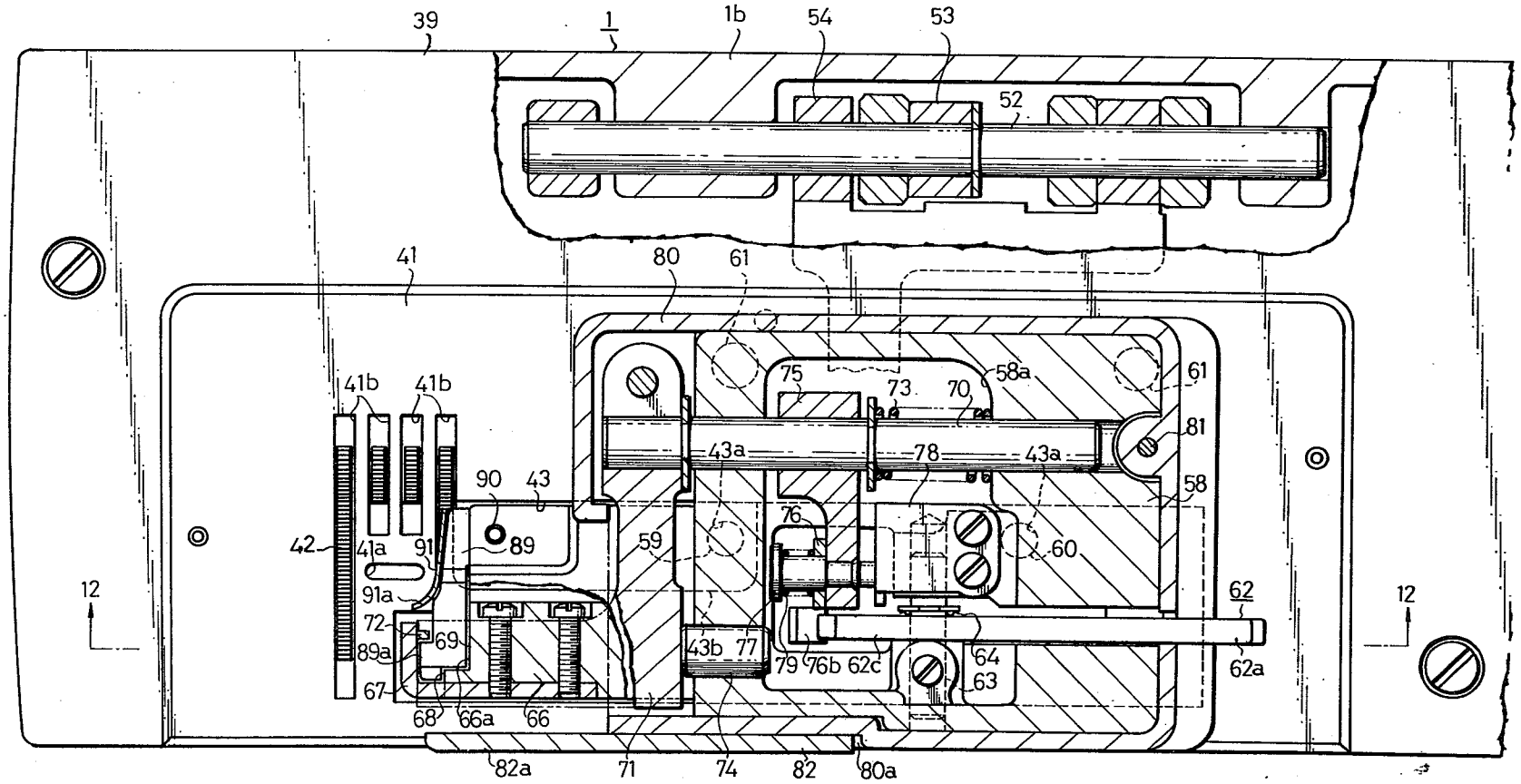
FIG. 11 is a partial plan view of the sewing machine illustrating in the partially cut-out state the trimming device mounted on the machine bed.
Figure 12:
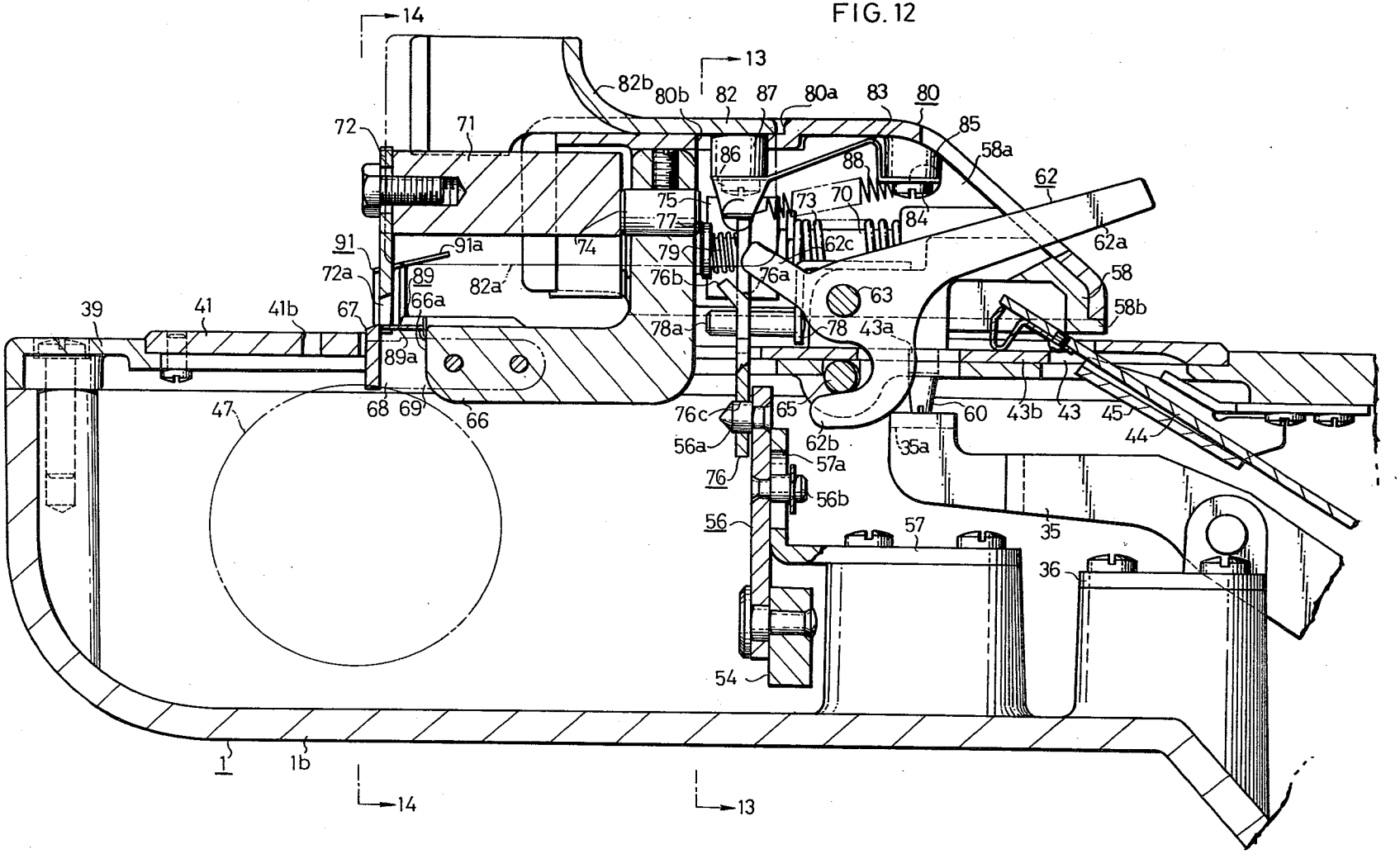
FIG. 12 is a view showing the section taken substantially along the line 12—12 in FIG. 11.

As shown in FIG. 1 and FIGS. 11 to 14, an upper plate 39 is fixed to the top surface of the bed portion 1*b* and a cover 40 is openably attached to the front surface of the bed portion 1*b*. A throat plate 41 is fixed to the top surface of the upper plate 39 and co-operates with the upper plate 39 to form a work supporting surface. On the left side of the throat plate 41, a needle aperture 41*a* for zigzag stitching and apertures 41*b* or a feed dog 42 are formed as shown in FIG. 11. An attaching opening 43 is formed on the right side of the throat plate 41, and as shown FIGS. 11 and 12, a supporting seat 43*b* provided with a pair of left and right fitting apertures 43*a* is formed in the opening 43. A cover plate 44 is disposed for openably closing the attaching opening 43 of the throat plate 41. As shown in FIGS. 3 and 12, when the opening 43 is opened, the cover plate 44 is stored in the bed portion 1*b* in the state inclined along a guide member 45 attached to the lower surface of the upper plate 39.

Figure 13:
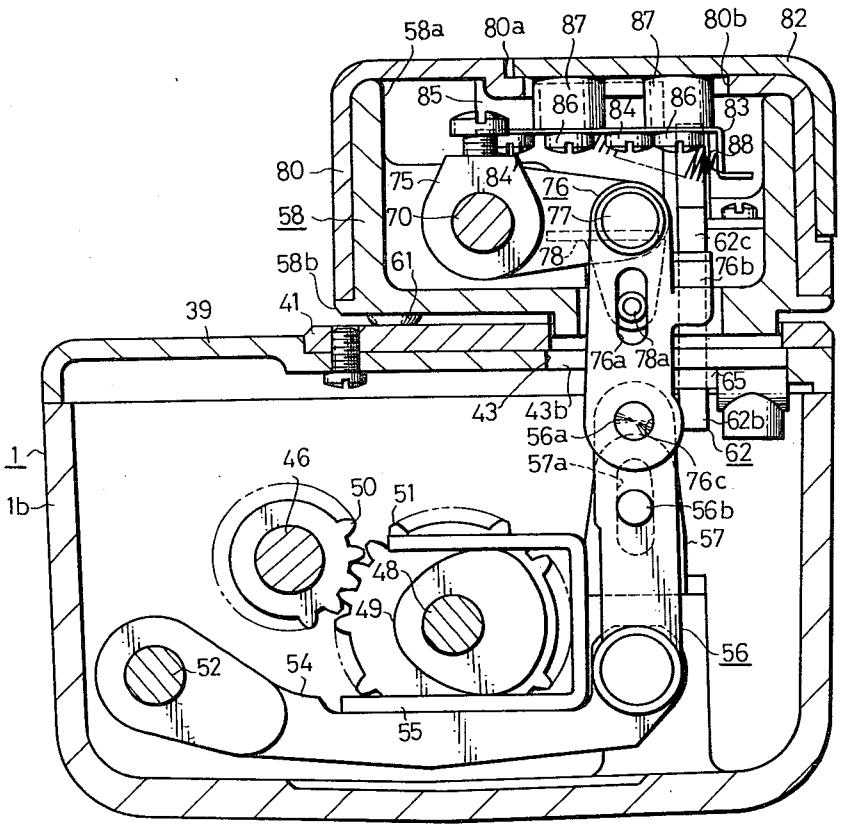
FIG. 13 is a view showing the section taken substantially along the line 13—13 in FIG. 12.

As shown in FIG. 13, a driving shaft 46 is supported in the bed portion 1*b* of the frame 1 so that it can rotate synchronously with the main shaft 7 to drive a loop taker 47 shown in FIG. 12 through an appropriate gear mechanism (not shown). Accordingly, the driving shaft 46 constitutes a part of the motion mechanism of the sewing machine. A cam shaft 48 is rotatably supported in the bed portion 1*b* in the vicinity of the driving shaft 46. A feed advancing cam (not shown) for operating the feed dog 42 and an actuating cam 49 for driving the attachment are fixed to the cam shaft 48. The cam shaft 48 is rotated at a reduced speed through gears 50 and 51 with rotation of the driving shaft 46. Accordingly, the cam shaft 48 constitutes a part of the feed mechanism. A stationary shaft 52 is mounted in the bed portion 1*b* and as shown in FIG. 11, a feed advancing arm 53 of the feed mechanism is rotatably supported on the shaft 52. An actuating arm 54 is rotatably supported at the rear end thereof on the stationary shaft 52. As shown in FIG. 13, a forked engaging piece 55 engaging with the actuating cam 49 is fixed to the front end of the actuating arm 54. Accordingly, the actuating arm 54 is oscillated by the actuating cam 49 with rotation of the cam shaft 48. An actuating link 56 is rotatably attached at the lower end thereof to the front end of the actuating arm 54. As shown in FIGS. 12 and 13, a connection pin 56*a* having a conical head is projected on the left surface of the actuating link 56, and a guide pin 56*b* to be fitted in a vertical slot 57*a* on a limiting plate 57 fixed in the bed portion 1*b* is projected on the right surface of the actuating link 56. Accordingly, the actuating link 56 is reciprocatively moved substantially in the vertical direction by engagement of the guide pin 56*b* with the vertical slot 57*a* with oscillation of the actuating arm 54.

The structure of the trimming attachment detachably mounted on the throat plate 41, which is located in the vicinity of the attaching opening 43 of the throat plate 41 after the opening 43 is opened, will now be described.

As shown in FIGS. 11 to 14, an attachment frame 58 has a front half part of its lower end slightly projected downwardly so that it is placed on the supporting seat 43*b* in the above-mentioned opening 43. An accommodating portion 58*a* opened upwardly is formed in the interior of the attachment frame 58 and a flange 58*b* is formed on the lower end of the periphery of the frame 58 except the left surface. A pair of vertical positioning projections 59 and 60 are provided on the lower surface of the attachment frame 58. As shown in FIG. 3, 11 and 12, when the attachment frame 58 is attached in the vicinity of the opening 43 of the throatplate 41, both the projections 59 and 60 are fitted in the fitting apertures 43*a* on the supporting seat 43*b*, whereby the position of the frame 58 is determined in the front-rear direction left-right direction. A pair of supporting rubber legs 61 are projected from the lower surface of the attachment frame 58 so that while the frame 58 is attached, the legs 61 butt against the upper surface of the throat plate 41.

Figure 15:
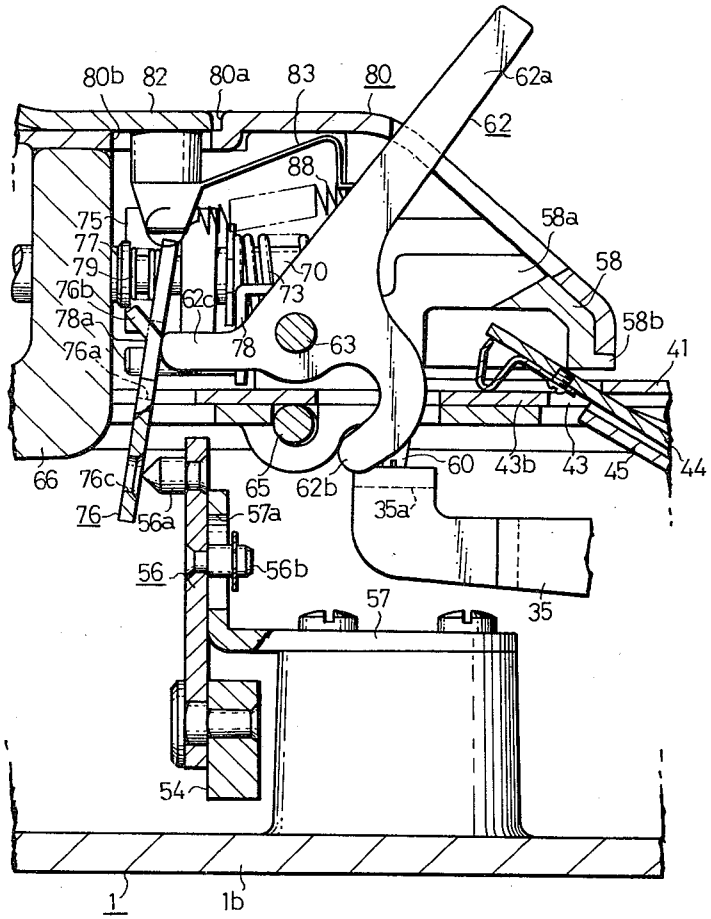
FIG. 15 is a sectional partial view corresponding to FIG. 12, which illustrates a different operation state.

A lock lever 62 is supported in a slit formed on the right wall of the attachment frame 58 so that it can be frictionally rotated around a horizontal support shaft 63 by the action of a spring washer 64. As shown in FIGS. 12 and 15, the lock lever 62 has a three-pronged shape and comprises an operated portion 62*a* projected to the right side of the attachment frame 58, a latching portion 62*b* having a cam surface projected through the opening 43 of the throat plate 41 below the upper plate 39 and an actuating portion 62*c* projected into the accommodating portion 58*a* of the attachment frame 58. When the lock lever 62 is turned in the clockwise direction from the release position shown in FIG. 15 by the operated portion 62*a* in the state where the attachment frame 58 is attached in the vicinity of the opening 43 of the throat plate 41, the cam surface of the latching portion 62*b* falls in engagement from below with an engagement shaft 65 fixed to the upper plate 39 as shown in FIG. 12, whereby the attachment frame 58 is fixed so that it is not allowed to move upwardly.

A projection arm 66 is formed integrally with the attachment frame 58 to extend in the lateral direction from the lower portion of the front end on the left side of the attachment frame 58, and as shown in FIGS. 11 and 12, a notch 66*a* is formed at the rear part of the left end of the arm 66. In the state where the attachment frame 58 is thus attached, the projection arm 66 is inserted into the opening 43 of the throat plate 41, and the upper surface of the arm 66 is located at substantially the same level as the work supporting surface, that is, the upper surface of the throat plate 41. A stationary blade 67 having a substantially L-shape in plan is fixed at the base end thereof to the front surface of the left end of the projection arm 66, and in the state where the attachment frame 58 is attached as shown in FIGS. 11 and 12, the cutting edge of the blade 67 is located in the vicinity the front side of the needle aperture 41*a* on the throat plate 41 on substantially the same level as the work supporting surface. Between this cutting edge and the left end of the projection arm 66, there are formed a gap 68 allowing intrusion of a movable blade described hereinafter and a gap 69 continguous to said gap 68, which allows projection of the top end of feed dog 42 located on the right side of the needle aperture 41*a*.

Figure 14:
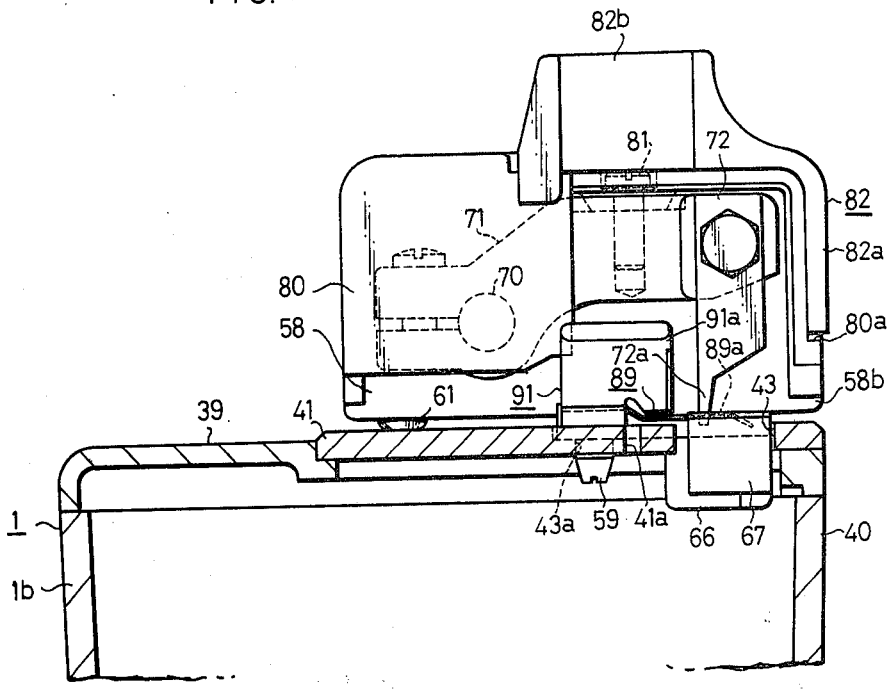
FIG. 14 is a view showing the section taken substantially along the line 14—14 in FIG. 12.

A drive shaft 70 is rotatably supported on the attachment frame 58 in the vicinity of the rear end thereof. A drive arm 71 having a substantially L-shape in plan is attached to the left end of the drive shaft 70. As shown in FIGS. 11, 12 and 14, the front portion of the drive arm 71 is extended in parallel to the projection arm 66 spacedly therefrom above the latter, so that the front portion of the drive arm 71 is moved in the vertical direction with reciprocative turning motion of the drive shaft 70. A movable blade 72 is attached to the left end of the front portion of the drive arm 71 to constitute a trimming section in co-operation with the above-mentioned stationary blade 67. A cutting edge and a guide projection 72*a* are formed on the lower end of the movable blade 72. The movable blade 72 is adapted to trim the marginal edge of the work fabric along the right end position of the maximum oscillation region W of the needle 6 shown in FIG. 10 in relation to reciprocative turning motion of the drive shaft 70. A compression spring 73 is disposed in the accommodating portion 58*a* of the attachment frame 58 to urge the drive shaft 70 to the left and always press the movable blade 72 to the stationary blade 67. A displacement limiting pin 74 is projected on the left surface of the attachment frame 58 to butt against the right end of the drive arm 71, and when a thick work fabric is trimmed, even if a force separating the movable blade 72 from the stationary blade 67 is imposed on the movable blade 72, the drive arm 71 is prevented from moving in the same direction.

A rock arm 75 is fixed to the central portion of the drive shaft 70 in the accommodating portion 58*a* of the attachment frame 58. A connection arm 76 is attached at the top end thereof to the front end of the rock arm 75 through an attaching pin 77 so that the arm 76 can rotate and move in the axial direction. As shown in FIGS. 12 and 13, a vertical slot 76*a* to be engaged with a pin 78*a* on a guide plate 78 fixed in the attachment frame 58 is formed in the central portion of the connection arm 76, whereby the arm 76 is allowed to make reciprocative movement substantially in the vertical direction by the engagement of the pin 78*a* with the vertical slot 76*a*. An abutment portion 76*b* to be engaged with the actuating portion 62*c* of the lock lever 62 is formed on the front edge of the central portion of the connection arm 76. A connection bore 76*c* corresponding to the connection pin 56*a* of the actuating link 56 is formed in the lower end portion of the connection arm 76 so that when the attachment frame 58 is attached on the throat plate 41, the bore 76*c* is projected into the bed portion 1*b* through the attaching opening 43 and becomes fitted to the connection pin 56*a*. A compression spring 79 is interposed between the head of the attaching pin 77 and the connection arm 76 to urge and move the arm 76 toward the actuating link 56 in the state where the attachment frame 58 is attached, so that while the actuating link 56 makes one reciprocative movement in the vertical direction, the connection bore 76*c* is fitted into the connection pin 56*a* and this state is maintained.

A casing 80 is fixed on the flange 58*b* of the attachment frame 58 by two screws 81 so as to cover the outer peripheral surface of the attachment frame 58 except the front portion of the left surface and the lower surface. As shown in FIGS. 12 to 16, an attaching recess 80*a* is formed on the casing 80 and an opening 80*b* is formed on the top surface of the attaching recess 80*a*. A shield member 82 is attached in the attaching recess 80*a* of the casing 80 to project to the left over the casing 80. As is apparent from FIGS. 1, 11, 12 and 14, a cover portion 82*a* of the shield member 82 covers the upper and front regions of the drive arm 71 inclusive of the movable blade 72 and partially covers the front region of the clearance between the drive arm 71 and the projection arm 66. Furthermore, a surrounding portion 82*b* projected from the top surface of the shield member 82 covers the screw 5 for attaching the needle 6 on the front rear and right sides thereof. Thus, a risk that an operator's finger or the like will be inserted in any of these portions is eliminated.

Figure 16:
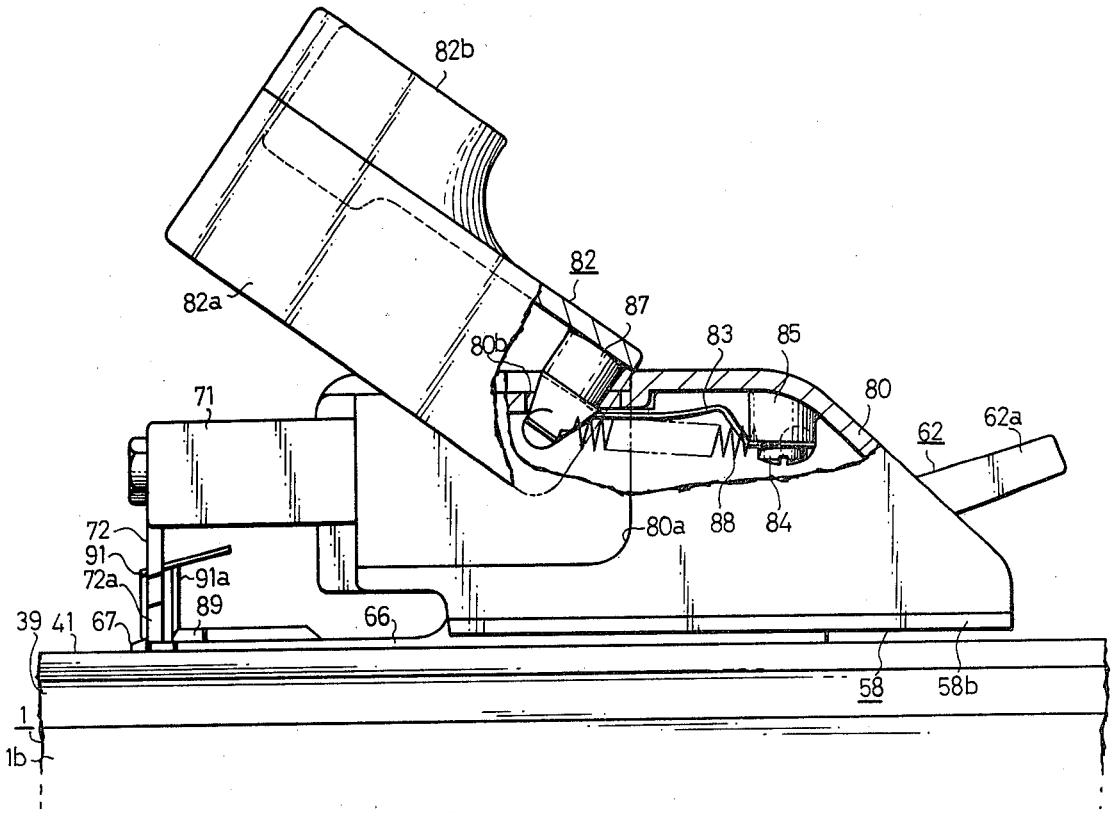
FIG. 16 is a front view of the trimming device which illustrates the state where a shield member is opened.

A connection member 83 composed of an elastic plate such as a plate spring is fixed at one end thereof to bosses 85 projected downwardly from the top wall of the casing 80 by a pair of screws 84, and the other end of the connection member 83 is fixed by a pair of screws 86 to bosses 87 projected downwardly from the right end of the top wall of the shield member 82 through the opening 80*b* of the casing 80. The connecting member 83 supports the shield member 82 so that the shield member 82 is temporarily opened the attaching recess 80*a* of the casing 80 as shown in FIG. 16. A tension spring 88 is laid out between both the fixed ends of the connection member 83 to urge the shield member 82 toward the shield position shown in FIG. 1. Accordingly, when trimmings, which is formed by the trimming operation of the trimming section comprising the stationary blade 67 and movable blade 72 and is accumulated on the upper surface of the projection arm 66 and other portions, are removed, the shield member 82 is temporarily opened against the action of the tension spring 88 as shown in FIG. 16, whereby the front region of the drive arm 71 and the trimming section is opened. Therefore, the operation of removing trimmings can be performed very easily. If this operation of opening the shield member 82 is released, the shield member 82 is automatically returned to the shielding position shown in FIG. 1 by the action of the tension spring 88 and there is attained the state where overedge stitching can be performed very safely.

As shown in FIGS. 1, 11, 12 and 14, a resilient plate 89 as well as deflecting plate 91 is fixed to the lower surface of the projection arm 66 on the left end thereof by a screw 90. A cover portion 89*a* is formed on the front prolonged portion of the resilient plate 89 to cover gaps 68 and 69 between the left end of the projection arm 66 and the cutting edge of the stationary blade 67 so as to prevent trimmings from intruding into these gaps. The cover portion 89*a* is adapted to butt against the movable blade 72 at the trimming step and to bend and intrude into the gaps 68 and 69. The left edge portion of the deflecting plate 91 is bent to form a deflecting portion 91*a* for guiding trimmings from the trimming section toward the right rear side.

In the foregoing embodiment, the positioning projection 60 formed on the right side of the lower surface of the attachment frame 58 is prolonged so that the projection 60 also acts as an operating projection for turning the opeated lever 35 disposed in the bed portion 1*b* of the machine frame 1. As shown in FIG. 3, when the trimming attachment is attached at the predetermined position on the throat plate 41, the projection 60 is engaged with the operated portion 35*a* of the operated lever 35 to turn the lever from the position indicated by the chain line in FIG. 3 to the position indicated by the solid line against the action of the tension spring 38. Accordingly, as is seen from FIG. 10, the field position of the needle oscillation is automatically changed in the relatively large oscillation amplitude region L for overedge stitching so that zigzag stitches are placed along and over the marginal edge of the work fabric trimmed by the above-mentioned trimming section.

The operations of the zigzag sewing machine having the above-mentioned structure will now be described.

The ordinary sewing operation is carried out in the state where the trimming attachment is not attached on the throat plate 41 and the attaching opening 43 of the throat plate 41 is closed by the cover plate 44. In this case the operated lever 35 disposed in the bed portion 1*b* of the frame 1 is located at the position indicated by the chain line in FIG. 3 by the action of the tension spring 38, and the switching member 29 mounted on the rock member 12 is held at the inoperative position shown in FIG. 8 and the small-diameter contact roller 23 on the connecting rod 21 is engaged with the first abutment surface 12*d* of the rock member 12. In this state, one pattern cam 13 corresponding to the desired stitch pattern is selected by the knob (not shown) on the front surface of the frame 1, and the oscillation amplitude of the needle 6 is appropriately set by the knob 25 shown in FIG. 2. When the sewing machine is operated in this state, based on rotation of the pattern cam 13 driven synchronously with the main shaft 7, the rock member 12 is oscillated. The oscillation of this member 12 is given to the needle 6 through the connecting rod 21 and the like, and the needle 6 is oscillated at the predetermined amplitude with the base line X1 based on the first abutment surface 12*d* of the rock member 12 being as the center, whereby a desired stitch pattern is formed at the so-called central field position of the needle oscillation.

For performing an overedge stitching while trimming the marginal edge of the work fabric by using the trimming attachment, as shown in FIG. 15, at first the cover plate 44 on the throat plate 41 is opened, and the lock lever 62 of the trimming attachment is turned to the release position to incline the connection arm 76. In this state, the trimming attachment is located in the vicinity of the attaching opening 43 of the throat plate 41. As a result, the positioning projections 59 and 60 on the lower surface of the attachment frame 58 are fitted in the fitting apertures 43*a* of the supporting seat 43*b* on the throat plate 41 and the position of the attachment frame 58 is set with respect to the front-rear direction and the left-right direction. Thereafter, as the lock lever 62 is turned in the clockwise direction from the release position shown in FIG. 15, the latching portion 62*b* falls in engagement with the engagement shaft 65 on the upper plate 39 from below as shown in FIG. 12 and the attachment frame 58 is locked so that it cannot be moved upwardly. Simultaneously, the actuating portion 62*c* of the lock lever 62 is separated from the abutment portion 76*b* of the connection arm 76 and the arm 76 is pressed to the actuating link 56 in the bed portion 1*b* by the action of the compression spring 79. While with operation of the sewing machine the actuating link 56 is allowed to make one reciprocative movement in the vertical direction, the connection pin 56*a* of the actuating link 56 becomes capable of being fitted into the connection bore 76*c* of the connection arm 76.

When the trimming attachment is thus locked at the predetermined position on the throat plate 41, the right positioning projection 60 formed on the lower surface of the attachment frame 58, which acts also as the operating projection, is engaged with the operated portion 35*a* of the operated lever 35 mounted in the bed portion 1*b*, and the lever 35 is turned from the position indicated by the chain line in FIG. 3 to the position indicated by the solid line against the tension spring 38. Whereby the actuating arm 30 on the front surface of the rock member 12 and the actuating plate 31 are moved upwardly through the link 37 and the actuating element 33*a* of the actuating pin 33 is moved upwardly between the guide surface 12*a* of the rock member 12 and the left side surface of the switching member 29, so that the switching member 29 is turned from the inoperative position shown in FIG. 8 to the operative position shown in FIG. 6. In this state, the large-diameter contact element 22 on the connecting rod 21 is engaged with the second abutment surface 29*a* of the switching member 29 and the small-diameter contact roller 23 is separated from the first abutment surface 12*d* of the rock member 12. As a result, the relative position of the connecting rod 21 to the rock member 12 is shifted to the right with respect to the lengthwise direction.

In this state, in substantially the same manner as described above, one pattern cam 13 corresponding to the stitch pattern suitable for overedge stitching is selected and the oscillation amplitude of the needle 6 is set at an optional value within the oscillation amplitude region suitable for overedge stitching. When the sewing machine is operated in this state, as is seen from FIGs. 11 to 13, rotation of the driving shaft 46 is transmitted to the drive arm 71 through the actuating cam 49, actuating arm 54, actuating link 56, connection arm 76, rock arm 75 and drive shaft 70, and the movable blade 72 is reciprocatively moved in the vertical direction. By the cooperation of the movable blade 72 and the stationary blade 67, the marginal edge of the work fabric is trimmed along the right end position of the maximum oscillation region W of the needle 6. Furthermore, based on rotation of the pattern cam 13 with the operation of the sewing machine, the rock member 12 is oscillated and the needle 6 is oscillated with the base line X2 based on the second abutment surface 29*a* shown in FIG. 10, which is different from the base line Xl shown in FIG. 9, being as the center. At any amplitude with the abovementioned region L of the needle, an overedge seam is formed at the so-called right field position of the needle oscillation along the right end position of the maximum amplitude region W so as to overcast the trimmed edge of the work fabric.

For performing the ordinary sewing operation again the trimming attachment is taken out in the following manner. When the lock lever 62 is turned from the lock position shown in FIG. 12 in the counterclockwise direction, the latching portion 62*b* is separated from the engagement shaft 65 on the upper plate 39 as shown in FIG. 15 and the attachment frame 58 is released from the locked state. Simultaneously, the actuating portion 62*c* of the lock lever 62 is engaged with the abutment portion 76*b* of the connection arm 76 and the arm 76 is turned into the inclined state, and the connection pin 56*a* of the actuating link 56 is separated from the connection bore 76*c* of the connection arm 76. Accordingly, in this state, the trimming attachment can be withdrawn upwardly from the throat plate 41. In relation to this withdrawal of the trimming attachment, the operated lever 35 in the bed portion 1*b* is shifted to the position indicated by the chain line shown in FIG. 3 by the action of the tension springs 38 and the switching member 29 on the rock member 12 is turned to the inoperative position shown in FIG. 8 and the field position of the needle oscillation is automatically returned to the center.

The present invention is by no means limited to the structure of the above-mentioned embodiment, but various modifications and changes such as described can be made.

(1) The first abutment surface 12*d* on the rock member 12 and the contact roller 23 on the needle bar connecting rod 21 are removed from the foregoing embodiment, one contact element 22 mounted on the connecting rod 21 is arranged so that it is always engaged with the abutment surface 29*a* of the switching member 29, and the field position of the needle oscillation is changed with the shift of the switching member 29.

(2) An arcuate abutment surface 29*a* is formed substantially along the entire length of the switching member 29, so that the field position of the needle oscillation can be changed over the entire region of the variable oscillation amplitude of the needle 6.

(3) In the structure of the foregoing embodiment where the rock member 12 is oscillated around one axis by the pattern cam 13, the rock member 12 is arranged so that the position of the pivotal axis of the rock member 12 is temporarily shifted to change the field position of the needle oscillation.

(4) Instead of the rock member oscillated by the cam control, which is used as oscillating means in the foregoing embodiment, an actuator controlled by stitch data stored in a semiconductor memory (disclosed in U.S. Pat. No. 3,872,808) is employed, and an operational circuit or the like for modifying stitch data put out from the semiconductor memory is used as switching means.

(5) When the trimming attachment is disposed on the bed portion 1*b* in the foregoing embodiment, the operated lever 35 in the bed portion 1*b* is turned in relation to the turning operation of the lock lever 62 and the field position of the needle oscillation is automatically changed.

(6) The attachment type of the trimming device adopted in the foregoing embodiment is changed to a type to be built in the bed or arm of the sewing machine, and when at least the movable blade is disposed in the state exposed to the predetermined position on the bed surface of the sewing machine, the field position of the needle oscillation is automatically changed in relation to the disposition operation.

(7) Instead of the operated means comprising the operated lever 35 and the link 37, which is used in the foregoing embodiment, there are provided an electromagnetic solenoid connected to the actuating arm 30 and a switch operated to energize or de-energize the electromagnetic solenoid relatively to the disposition of the trimming device at a predetermined position.

(8) Other changes may be made to structures of the respective parts without departing from the scope of the present invention.

As will be apparent from the foregoing illustration, according to the present invention, since the field position of the needle oscillation is automatically changed and set in relation to the disposition of the trimming device at the predetermined position, no troublesome operation is necessary for manually changing the field position of the needle oscillation. Furthermore, even if the stitch width is changed at the overedge stitching step, an overedge seam can be formed so that the trimmed marginal edge of a work fabric is always overcast. Moreover, when the trimming device is withdrawn from the predetermined position, the field position of the needle oscillation is automatically shifted from the changed state to the original state and an ordinary sewing operation can be immediately started without any trouble very smoothly.

What we claim is:

1. A zigzag sewing machine with a trimming device for trimming the marginal edge of a work fabric, comprising; a machine frame including a bed portion on which said trimming device is removably disposed to be actuated in relation to the operation of said sewing machine, a needle carried by said frame for endwise reciprocation and lateral oscillation, oscillating means operatively connected with said needle to laterally oscillate the latter for forming zigzag stitches of variable stitch width, switching means co-operating with said oscillating means for changing the field position of the needle oscillation, and operated means for actuating said switching means in relation to the disposition of said trimming device in a predetermined position on said bed portion, whereby the field position of the needle oscillation is set to place zigzag stitches along and over the trimmed edge of the work fabric on performing overedge stitching by using said trimming device.

2. A zigzag sewing machine according to claim 1, wherein said trimming device comprises an attachment which is detachably locked in the predetermined position on said bed portion, said switching means is actuated by said operated means in relation to the operation for locking said attachment on said bed portion.

3. A zigzag sewing machine according to claim 2, wherein said operated means includes an operated lever pivotally mounted in said bed portion, and said trimming attachment includes a projection which is formed on the lower surface of said attachment for engagement with said operated lever.

4. A zigzag sewing machine according to claim 1, wherein said trimming device includes a pair of trimming blades for trimming the marginal edge of the work fabric, in the held state of said trimming device on said bed portion, at any one of either end positions in the maximum needle oscillation range, and said switching means actuates for setting the field position of the needle oscillation to substantially coincide with said one end position during the formation of zigzag stitches of stitch width suitable for the overedge stitching.

5. A zigzag sewing machine according to claim 1, wherein said oscillating means includes pattern cam means driven in timed relation with said sewing machine and a rock member pivotably mounted in said frame to be rocked according to the cam shape of said pattern cam means, and said switching means includes a switching member shiftably mounted on said rock member to cooperate therewith for changing the field position of the needle oscillation.

6. A zigzag sewing machine with a trimming device for trimming the marginal edge of a work fabric, comprising; a machine frame including a bed portion on which said trimming device is removably disposed to be actuated in relation to the operation of said sewing machine, a main shaft rotatably mounted in said frame, a needle carried by said frame for endwise reciprocation and lateral oscillation, pattern cam means driven by said main shaft, a rock member pivotably mounted in said frame to be rocked according to the cam shape of said pattern cam means, a connecting rod operatively connecting said rock member with said needle for laterally oscillating the latter, a regulating member operatively connected with said connecting rod to regulate the amplitude of the needle oscillation for forming zigzag stitches of desired stitch width, a switching member mounted in said frame for movement between an inoperative position and an operative position for cooperating with said rock member to change the field position of the needle oscillation, and operated means operatively connected with said switching member for moving it to the operative position in relation to the disposition of said trimming device in a predetermined position on said bed portion, whereby the field position of the needle oscillation is set to place zigzag stitches of desired stitch width along and over the trimmed edge of the work fabric on performing overedge stitching by using said trimming device.

7. A zigzag sewing machine according to claim 6, wherein said switching member is adapted to change, upon movement thereof, the position of said connecting rod relative to said rock member in a lengthwise direction of said connecting rod.

8. A zigzag sewing machine according to claim 6, further comprising spring means for urging said operated means to normally hold said switching member in the inoperative position, and wherein said switching member is moved to the operative position against the action of said spring means upon the disposition of said trimming device in the predetermined position on said bed portion.

9. A zigzag sewing machine according to claim 6, wherein said regulating member is manually operated for shifting said connecting rod to regulate the distance between the pivotal point of said rock member and the connection point of said connecting rod with said rock member, and wherein said switching member actuated for setting the field position of the needle oscillation to coincide with a position for trimming the marginal edge of the work fabric by said trimming device on performing overedge stitching at a relatively large amplitude of the needle oscillation set by said regulating member.

10. A zigzag sewing machine according to claim 6, wherein said rock member is carried by a shaft secured to said frame and is formed with a first abutment surface with which said connecting rod normally engages for setting the central field position of the needle oscillation, said switching member is pivotably mounted on said rock member and is formed with a second abutment surface selectively engageably with said connecting rod for substantially setting the right field position of the needle oscillation, and said operated means is operated for engaging said connecting rod with said second abutment surface instead of said first abutment surface.

* * * * *